US005374919A

United States Patent [19]

Zelka et al.

[11] Patent Number: 5,374,919

[45] Date of Patent: Dec. 20, 1994

[54] PERSONAL SAFETY DEVICE

[76] Inventors: Sean R. Zelka; David A. Chavez, both of 5407 Lakemont Blvd. S.E. #232, Bellevue, Wash. 98006

[21] Appl. No.: 173,763

[22] Filed: Dec. 27, 1993

[51] Int. Cl.[5] ..... G08B 13/14; G08B 21/00

[52] U.S. Cl. ..... 340/574; 224/196; 224/226; 224/914; 340/568

[58] Field of Search ..... 340/574, 568; 224/0.5, 224/914, 191, 196, 226, 229

[56] References Cited

U.S. PATENT DOCUMENTS

| | | | |
|---|---|---|---|
| D. 238,725 | 2/1976 | Zerobnick et al. | D3/226 |
| 4,029,243 | 6/1977 | Zerobnick et al. | 224/224 |
| 4,588,116 | 5/1986 | Litman | 224/914 |
| 4,966,320 | 10/1990 | DeSantis et al. | 224/229 |
| 5,009,347 | 4/1991 | Phelps | 224/219 |
| 5,088,121 | 2/1992 | Wallace | 2/160 |
| 5,108,019 | 4/1992 | Woodward et al. | 340/568 |
| 5,302,302 | 4/1994 | Shelley et al. | 224/196 |

*Primary Examiner*—Glen Swann

*Attorney, Agent, or Firm*—Christensen, O'Connor, Johnson & Kindness

[57] ABSTRACT

A method and apparatus are provided for carrying and accessing multiple safety devices, wherein the removal of one safety device simultaneously activates a second safety device. The method includes removing a chemical spray canister secured to a pack body, wherein an activation cord pulls an alarm pin thereby activating an audible alarm. The apparatus includes a spray canister and an audible alarm attached to a pack body, the canister and alarm being concealed by a cover. The cover is attached to the pack body with multiple slide fasteners. The cover has attached thereto a rip cord, so that when the rip cord is pulled by the user, the cover is partially or completely removed to expose the spray canister and the alarm; the spray canister and the alarm are interconnected by a cord so that removal of the spray canister simultaneously activates the audible alarm.

12 Claims, 3 Drawing Sheets

PERSONAL SAFETY DEVICE

FIELD OF THE INVENTION

The present invention relates generally to personal safety devices, and more specifically, to multiple safety devices, wherein the removal of one safety device activates another device.

BACKGROUND OF THE INVENTION

The current community environment requires that individuals, whether alone or with others, take precautionary measures to protect themselves against personal assaults. Various personal safety devices are available, including firearms, stun guns, chemical sprays, and audible alarms.

While firearms, when accessible and handled properly, are good deterrents against an aggressor carrying out a personal injury or assault, carrying a firearm can be unattractive to individuals who oppose the possession and use of firearms, or who are generally intimidated by firearms. In addition, the idea that a death may occur in the event the firearm is used may also make individuals uncomfortable who would rather choose a less deadly form of deterrent. If a firearm is chosen as a personal safety device, many jurisdictions require registration of the weapon and, if the firearm is to be carried on the person, a concealed weapons permit must be obtained. The registration and permit may subject an individual to personal scrutiny, including having their name published in lists of firearm and concealed weapon permit applicants, which may be discomforting and discouraging to some people. In addition, there are numerous environments where firearms are not permitted including airport and other public forums.

Alternative personal protection devices such as chemical sprays (e.g., MACE TM and pepper sprays), audible personal security alarms, and stun guns, when used properly, can have a deterrent effect on an aggressor without the dire consequences of a firearm. However, such devices can prove ineffective in certain circumstances. For example, while stun guns may be effective in warding off aggressors, the aggressor must be reasonably close—within arms length of the victim—such that both prongs of the stun gun can be brought into contact with the assailant; use of a stun gun can be difficult if the assailant is physically overpowering or stays too far away.

Chemical sprays and audible alarms offer an advantage over stun guns, because the assailant does not have to be in contact with or physically as close to the victim (although the assailant must be reasonably close to use chemical sprays effectively). However, if the assailant becomes aware of the user's intention to use chemical sprays and the assailant has sufficient time and space to move away from the victim, he or she may avoid the spray or prevent the spray from directly contacting sensitive areas of their body. Consequently, the chemical spray may be ineffective.

Similarly, if the assailant is certain that no one will come to the victim's rescue when an alarm sounds (e.g., in larger metropolitan areas, alarms are continually sounding, and citizens have become so use to hearing alarms that they do not readily or rapidly respond), or wherein the victim is out of audible contact with other individuals, the audible alarm alone may be insufficient to stop the attacker's aggression.

Finally, a problem with any of the above-mentioned deterrent devices, is that they may not be readily accessible if they are carried in a closed bag or pocket into which the victim cannot reach or if the bag has been removed or is held closed by the assailant. Accordingly, there is a need for a total safety protection device that incorporates multiple safety deterrents. To be effective, the device must be readily accessible, activated with minimal effort and movement, and the removal or activation of one safety device should preferably activate other devices, thereby eliminating steps needed to use both devices so that the devices can be effectively deployed by a victim in a minimal time.

SUMMARY OF THE INVENTION

The present invention provides a method and apparatus for combining multiple safety devices into a single, convenient pack. The present invention improves the deterrent effect of a safety device system over alternative single safety devices carried or stored individually. More particularly, the present invention combines both a preferred embodiment of the present invention, the audible alarm is activated simultaneously with the removal of the chemical spray canister.

Further aspects of the present invention include a pack for conveniently storing the safety devices, wherein the pack has both a pack body adapted to be secured about the person and a fashionable cover concealing both the chemical spray canister and the audible alarm. Preferably the chemical spray canister is releasably secured to the pack body for quick release and access by the victim, while the audible alarm is more permanently, but removably, secured to the pack body. The cover of the safety device system has fasteners, which may include, but are not limited to, slide fasteners (ZIPPER TM), snaps, VELCRO TM or other suitably quick-release fasteners, so that the cover is easily removed either partially or completely.

Additional aspects of the present invention include the strategic placement of a rip cord or handhold member, preferably securely placed within or attached to a corner of the cover. By pulling on the handhold member, the pack cover is partially or completely removed to expose the deterrent device(s). In the preferred embodiment, a cover is fastened to a rectangular pack body by slide fasteners having a pair of sliders, which meet at a corner of the cover. The handhold member extends between the two sliders at the corner of the cover where the sliders meet, or if the handhold member is a digit aperture in the cover, the aperture is likewise located between the two sliders at the corner of the cover. To expose the deterrent devices, the user simply pulls the handhold member, if located in the upper right-hand corner of the cover, downward and to the lea, or, if located in the upper left-hand corner of the cover, downward and to the right; the specific location of the handhold member depends on whether the operator prefers a right-handed or a left-handed operation and whether the operator desires to pull the rip cord upward or downward.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention, while described in its preferred embodiment, is not meant to be limited with respect to the type of pack, compartment cover fasteners, and/or method used to expose the safety devices. While the preferred embodiment as described below in detail is composed of a simply fanny pack using a belt to secure the pack about the person, and slide fasteners to access the safety devices, it will be readily apparent to those skilled in the art that the inventive aspects of the present invention may be readily adapted to purses, bags, cases, jackets and other garments, which may be worn or carried by an individual desiring a personal safety device.

The invention provides access to multiple safety devices carried in a pack configured so that the activation and/or removal of one safety device simultaneously activates one or more other safety devices. In addition, while the preferred form of concealing and protecting the safety devices is in an enclosed pouch or compartment having slide fasteners around the compartment's perimeter, the safety devices may instead be exposed, without a protective cover(s) or be contained in any other suitable compartment or confining area. Alternatively, the protective cover(s) of the present invention may be fastened about the safety devices using other quick release fasteners, including snaps, VELCRO TM strips and/or quick release clips. Further, as will be described hereafter, the preferred fastener for releasably attaching the chemical spray canister to the body of the pack comprises VELCRO$^m$ strips; however, alternative fasteners will also be readily apparent to those skilled in the an and are similarly contemplated within the scope of this invention. Similarly, the audible alarm is removably secured to the pack body using elastic strips. It will be readily apparent to those skilled in the an that alternative securing fasteners may be used to secure the audible alarm that fall within the scope of the present invention.

Figure 1:
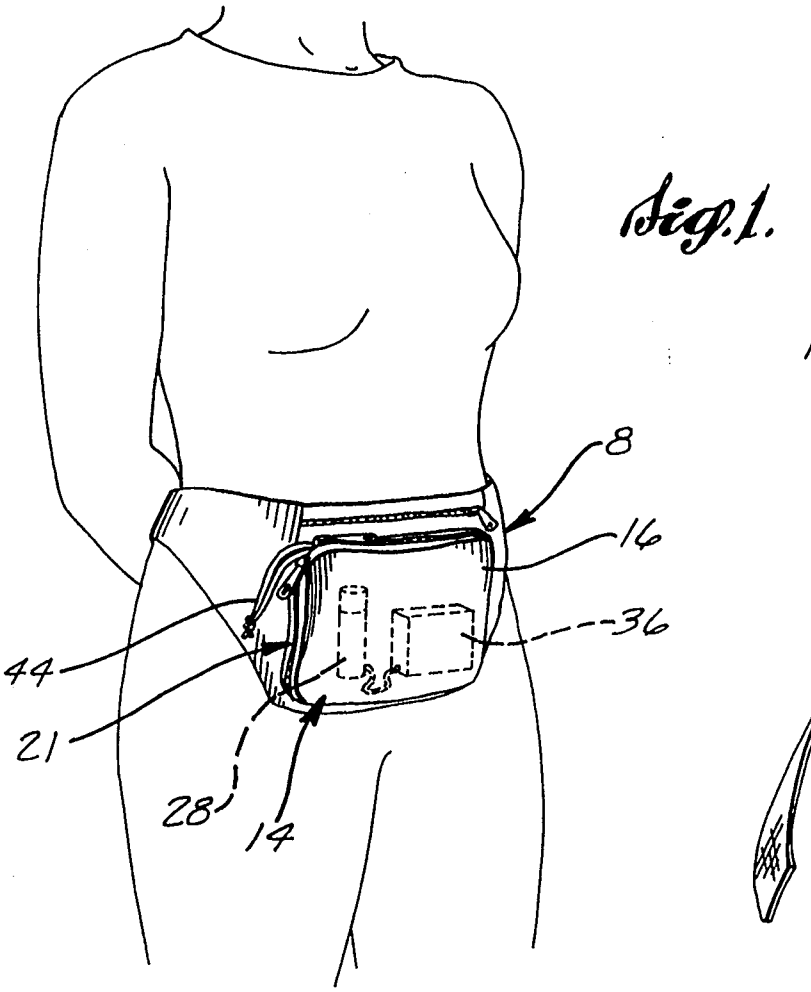
FIGS. 1 and 2 illustrate perspective views of the present invention, showing the safety device as it would be worn by an individual.
Figure 2:
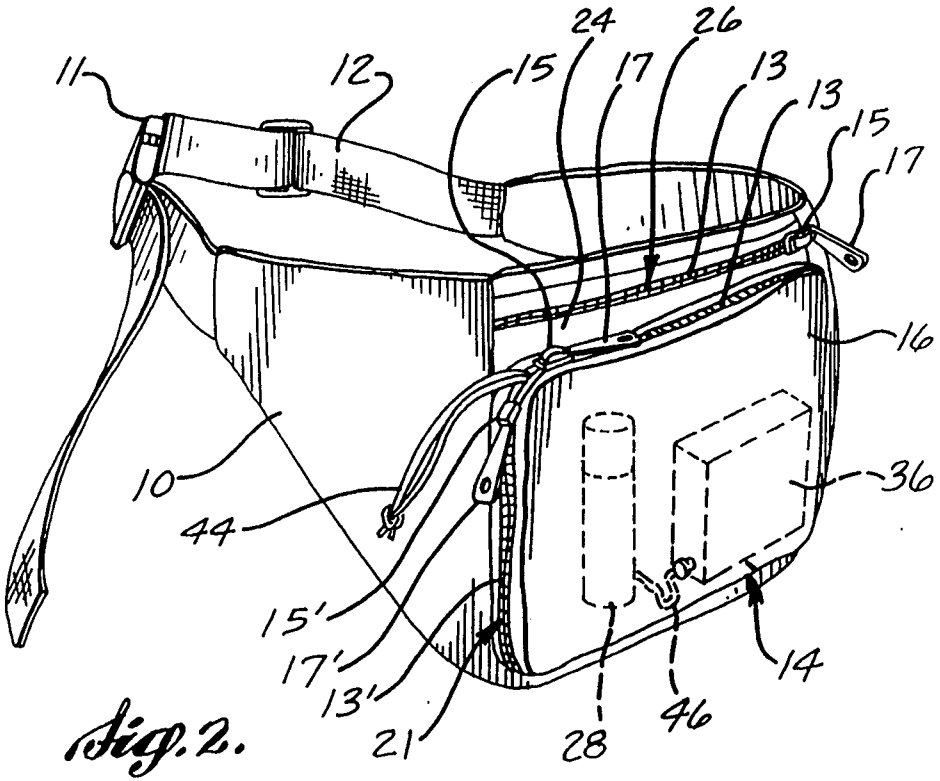

Referring to FIGS. 1 and 2, there is shown a front view of a pack 8 of the present invention. The pack 8 has a pack body 10 having attached thereto a securing strap 12 for preferably securing the pack about the forward midsection of a user such that the user can readily access the pack body 10; this arrangement is preferred to having the pack body 10 disposed in the rear extremities of the user, wherein access would be impeded by inconveniently having to reach behind one's back. The pack body 10 has a rectangular shaped primary pouch 14, and a secondary pouch 24 located behind the primary pouch 14. Both the primary pouch 14 and the secondary pouch 24 are attached to an outer extremity of the pack body 10, the primary pouch 14 being on the outer extreme perimeter of the pack body 10 for easy unrestricted access. The ends of the attachment strap 12 are attached together with a snap clip 11 for securing the strap 12 about the person's midsection. Other fastening devices may be used in place of the clip 11, including buckles, snaps, or one piece elastic strips. Neither the pack body 10 nor the primary pouch 14 are meant to be limiting with regard to the possible ways in which the present invention can be carded by a user, but instead are exemplary of the fashion in which the present invention is preferably used. Also, the fastening device may include a locking mechanism to prevent detachment of the strap unless desired by the wearer of the pouch.

Also shown in FIGS. 1 and 2 is a primary pouch slide fastener 21 extending around the perimeter of the primary pouch 14. The slide fastener 21 has two teeth chains (13, 13'), two sliders (15, 15') and two slide tabs (17, 17'). At a base or termination point of the two teeth chains (13, 13') a primary pack cover 16 is attached to the back body 10. The attachment point 23 is preferably located at a termination point of both teeth chains (13, 13') and serves as slide fastener stop 22. The pouch cover 16 preferably has a primary pouch handhold member or rip cord 44 attached to a corner of the pouch cover 16 opposite the slide fastener stop 22. The cord 44, while preferably a nylon cord, may be any releasing device including a tab (not shown) or a hole wherein the user may insert a digit and pull the cover open. The rip cord 44 is merely exemplary of a preferred handhold member for quickly accessing the primary pouch interior. Those skilled in the art will readily appreciate that any form of quickly accessing the interior of the pouch 14 falls within the purview of the present invention.

When an individual desires to access the safety device(s) (with the pack body 10 in the front portion of his or her midsection), the primary pouch rip cord 44 is grasped with the left hand and pulled downward and to the left. Likewise, but not shown in FIGS. 1 and 2, a pack body 10 designed for a left-handed person requires that the rip cord 44 be located in the upper left-hand corner so that an individual can grasp the primary pouch rip cord 44 with his or her right hand and pull the rip cord 44 downward and to the right to expose the interior of the primary safety device pouch 14. Further, if the user desires to pull the rip cord 44 upward, the rip cord 44 may be located in either the lower-left-hand or lower right-hand corner depending on whether the pack 8 is configured for a right-handed or a left-handed operation. The slide fastener stop 22 is premised on the desired opening configuration of the pouch cover 16. The sliders (15, 15') and the slide fastener stop 22 can be positioned anywhere around the perimeter of the pouch 14 wherein the sliders (15, 15') terminate at the slide fastener stop 22 and the pouch cover 16 opens about the fastener stop 22. Similarly, and not shown in the figures, the primary pouch 14 may be other than rectangular shaped including, but not limited to, circular or triangular. In a triangular configuration, an apex of the triangle may be positioned substantially upward wherein the rip cord 44 is located in the apex of the triangle between the sliders (15, 15')at a substantial center section of the pack body 10. The rip cord 44 may then be pulled primarily downward, to the right or to the left depending on the user's preference; this configuration allows one pack design to be used to accommodate either left-handed or right-handed users. Again, alternative shapes and designs of the pouch cover will be readily apparent to those skilled in the art and fall within the teachings of the present invention.

In the preferred embodiment, if an individual is right-handed, he or she will want to grasp the safety device(s) with the right hand, which requires the primary pouch rip cord 44 be grasped with the left hand. Similarly if the individual is a left-handed person, he or she will preferably want to grasp the safety device(s) with the left hand, which requires that the primary pouch rip cord 44 be grasped with the right hand. In either situation, left-handed or right-handed, the sliders (15, 15') of the slide fastener 21 will come together either in the upper right-hand corner or the upper left-hand corner, respectively, where the rip cord 44 is disposed between the two sliders (15, 15'). In this regard, as the rip cord 44 is pulled downward and to the left for a right-handed configuration, or downward and to the right for a left-handed configuration, the sliders (15, 15') will retract around the perimeter of the primary pouch cover 16, until the sliders (15, 15') reach the primary pouch slider stop 22. Accordingly, the interior of the primary safety device pouch 14 will be exposed so that the safety devices can be activated or removed.

Further shown in FIGS. 1 and 2 is a secondary pouch 24, and a secondary pouch slide fastener 26 located behind the primary pouch 14. Since the safety device of the present invention is worn much like a conventional fanny pack (but in the front), it may be desirable to have additional pouches for storing other items, such as currency, clothing, personal items, etc.

Figure 3:
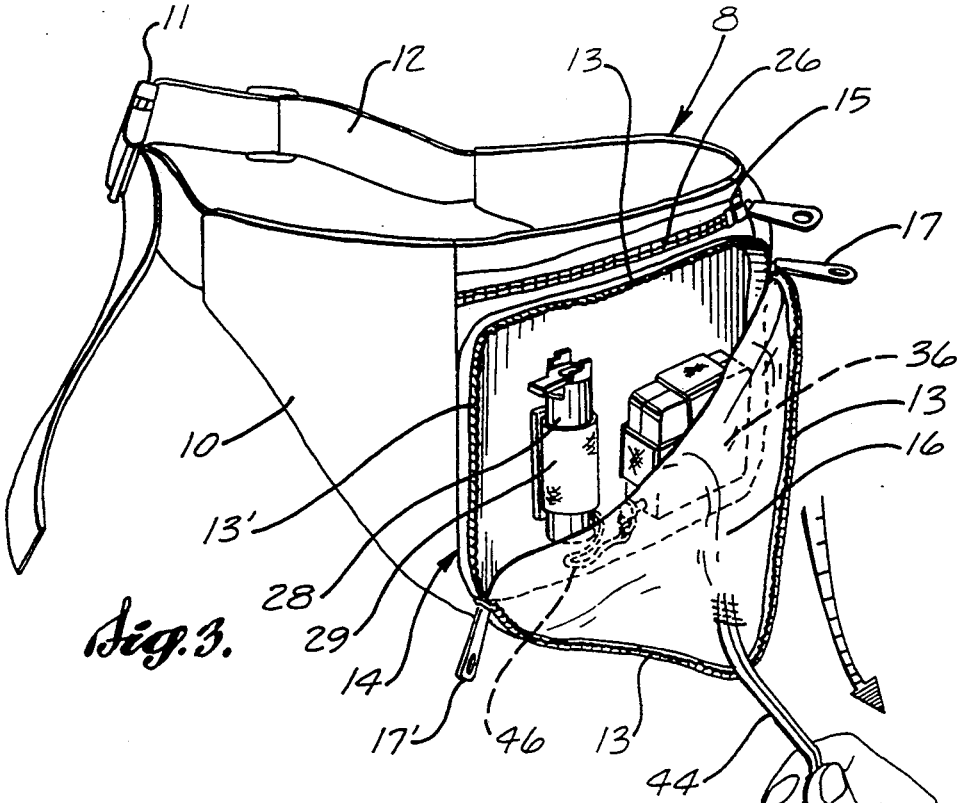
FIG. 3 is a perspective view of the present invention showing how a user obtains access to the multiple satiety devices contained within the primary safety device pouch.

Referring now to FIG. 3, the primary safety device pouch cover 16 is shown partially retracted to expose the safety device(s). As the rip cord 44 is pulled downward and to the left (for a right-handed configuration), both the first slider 15 and the second slider 15' retract around the perimeter of the pouch cover 16, releasing the cover from the pack body 10. The first slider 15 retracts around the upper and left edge of pouch cover 16, whereas the second slider 15' retracts down the right edge and along the bottom edge of the pouch cover 16. As the two sliders (15, 15') come together at the lower left-hand edge of the pouch cover 16, the sliders (15, 15') encounter the primary pouch slider stop 22. The slider stop 22 prevents the pouch cover 16 from being separated from the pack body 10, but allows the pouch cover 16 to hinge downwardly so as not to impede access to the safety device(s).

Figure 4:
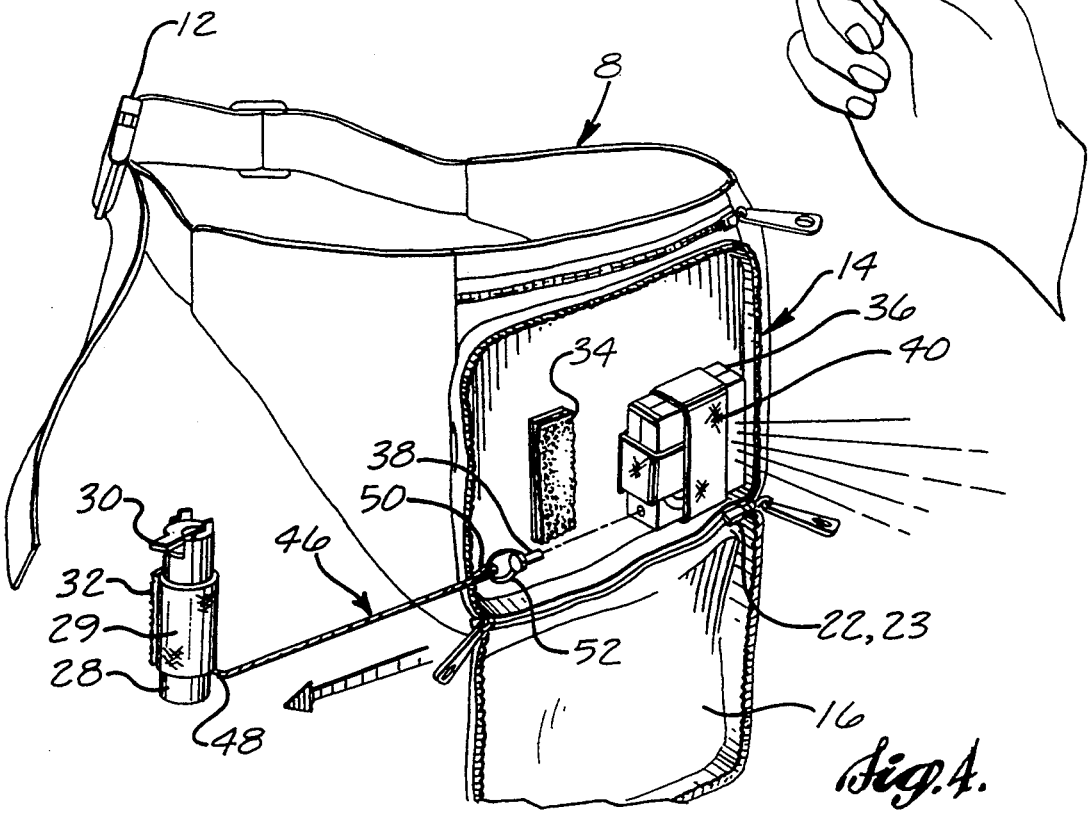
FIG. 4 is a perspective view of the present invention in its open configuration, exposing the interior of the primary safety device pouch.

Referring now to FIG. 4, the components of the personal safety device of the present invention are shown. The audible alarm 36 is preferably small and compact yet delivers an alarm sound sufficient to startle an aggressor and call attention to the user by others in the vicinity. While numerous other alarms could be used, the alarm employed in the preferred embodiment is a "Quorum"—Paal Sports; this alarm delivers a 110 dB shrill sound. The alarm 36 has an activation pin 38 having an actuation pin securing ring 52. When the activation pin 38 is removed, the alarm 36 will sound.

The alarm 36 is secured to the pack body 10 with an audible alarm securing strap 40. Preferably, the strap 40 is constructed of an elastic material, which securely holds the audible alarm 36 to the pack body 10, but wherein the audible alarm 36 can be readily removed for replacement of its battery, for storage, or to replace the entire audible alarm 36. It will be readily apparent to those skilled in the art that any removable fastener may be used including snaps and quick release clips. The improvement lies in the audible alarm being removable but not releasable from the pack body 10. In other words, wherein the chemical spray canister 28 is releasable from the pack body 10 to be held by the victim, the audible alarm remains attached to the pack body 10 and sounds until the activation pin 38 is reinserted (discussed in greater detail below).

Not shown but considered within the scope of the present invention, is an audio alarm housed within a second but more secure pouch than the primary pouch 14. Since it is undesirable for the aggressor to have access to the alarm wherein the aggressor may disarm and/or remove and discard the alarm, it may be preferably to keep the alarm in a secured substantially locked pouch. In this regard, activation of the alarm (discussed in greater detail below) could be performed through a small portal between the alarm pouch and the primary pouch 14. Of course, the alarm may be secured to the primary pouch by other ways so as to be non-removable by an aggressor.

Similarly contained within the primary safety device pouch 14 along side the alarm 36 is the chemical spray canister 28. The chemical spray canister 28, in the preferred embodiment, can be either MACE TM or pepper spray, however, it will be readily apparent to those skilled in the art that any functional spray may be used within the purview of the present invention. The chemical spray canister 28 is releasably attached to the pack body 10 using a VELCRO TM securing strap (a VELCRO TM loop strip 32 is attached to the back of the chemical spray canister 28 and a VELCRO TM hook strip 34 is attached to the pack body 10). The loop strip 32 may be attached directly to the canister, or if it is desirable to change or interchange canisters 28, the loop strip 32 may be attached to an elastic band 29 surrounding the chemical canister 28. In use, an individually simply grasps the chemical spray canister 28 and detaches it from the pack body 10; the chemical spray is then ready for use. If the user wishes to change the chemical spray canister 28, he or she merely removes the elastic band 29 from one canister and places it over another canister.

Also shown in FIG. 4 is the audible alarm interconnection member or activation cord 46. The interconnection member or cord 46 has a first end 48 adapted to be attached to the chemical spray canister 28. The first end 48 may be attached directly to the spray canister 28, but is preferably attached to the elastic band 29, so that when the spray canister 28 is interchanged, the activation cord 46 does not have to be replaced. The second end 50 of the activation cord 46 is attached to the activation pin 38 through the pin securing ring 52. When the releasably attached spray canister 28 is removed, the cord 46 is tightened until the tension is sufficient to pull or remove the audible alarm activation pin 38. Once the pin 38 is removed, the user now has the chemical spray canister 28 in his or her hand and the audible alarm 36 is simultaneously sounding. To stop the audible alarm 36, the user simply reinserts the activation pin 38 into the alarm body. While the preferred embodiment of the present invention uses a cord 46 as the interconnection member, this is not meant to limit the scope of the present invention. Rather, it will be readily apparent that any interconnection member can be used include cables, levers or electronic signally.

While the present invention is described in terms of the chemical spray canister 28 being releasably attached to the pack body 10 using a VELCRO TM fastener, alternative fasteners may also be used, including snaps or quick release clips. In addition, the canister 28 may simply be loose in the primary, safety device pouch 14 so that when the canister 28 is removed, it's removal pulls the activation cord 46 and simultaneously activates the audible alarm 36.

Figure 5:
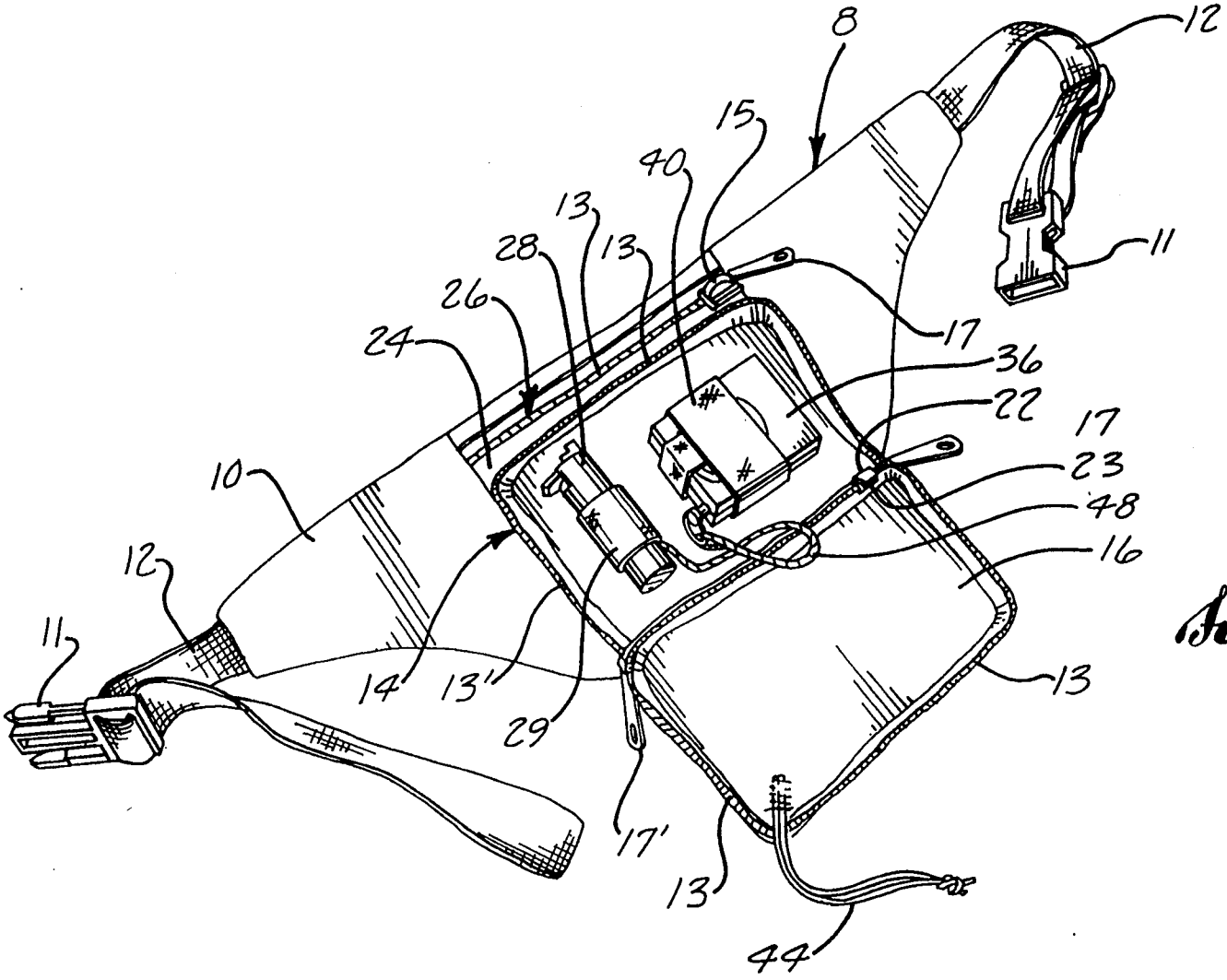
FIG. 5 is a perspective view of the present invention, showing the interior of the primary safety device pouch with the safety devices in use.

Shown in FIG. 5 is the interior of the primary safety device pouch 14 with the safety devices removed for purposes of illustration. As discussed above, the VELCRO TM hook strip 34 is permanently secured to the pack body 10 so that the chemical spray canister 28, having a VELCRO TM loop strip 32 attached thereto, can be reattached to the pack body 10 by simply touching the VELCRO TM loop strip 32 to the VELCRO TM hook strip 34.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of accessing and activating multiple personal safety devices wherein the safety devices are compact and designed to be carried on the person, comprising the steps of:

(a) pulling a first handhold member to expose the multiple safety devices;

(b) removing at least one of the multiple safety devices; and (c) automatically activating another of the multiple safety devices by removal of one of the multiple safety devices.

2. The method of claim 1, wherein an interconnection member operable interconnects the multiple safety devices wherein the removal of one of the multiple safety devices simultaneously activates another of the multiple safety devices.

3. The method of claim 2 wherein the interconnection member has a first end attached to one of the multiple safety devices and a second end attached to another of the multiple safety devices, the interconnection member operable interconnecting the multiple safety devices such that when one of the multiple safety devices is removed the interconnection member simultaneously activates another of the multiple safety devices.

4. The method of claim 3, wherein one of the multiple safety devices comprises a chemical spray canister and the other of the multiple safety devices comprises an audible alarm, the interconnection member being operable attached to the chemical spray canister and to the audible alarm, the interconnection member activating the audible alarm when the chemical spray canister is removed.

5. An apparatus for carrying, accessing and activating multiple personal safety devices wherein the safety devices are compact and designed to be carried on the person, comprising:

(a) a compartment for receiving and securely holding multiple safety devices; and (b) an interconnection member for operable interconnecting the multiple safety devices wherein removal of at least one of the multiple safety devices from the compartment automatically activates another of the multiple safety devices.

6. The apparatus of claim 5, wherein the interconnection member has a first end attached to one of the multiple safety devices and a second end attached to another of the multiple safety devices, the interconnection member operable interconnecting the multiple safety devices such that when one of the multiple safety devices is removed the interconnection member simultaneously activates another of the multiple safety devices.

7. The apparatus of claim 5, further comprising:

(a) a cover releasably attached to the compartment, the cover concealing the multiple safety devices; and (b) a handhold member secured to the cover wherein when the handhold member is manually grasped and pulled, the cover is removed to expose the multiple safety devices.

8. The apparatus of claim 7, wherein the handhold member has a first end secured to the cover and a second end free to be grasped and pulled to remove the cover thereby exposing the multiple safety devices.

9. The apparatus of claim 7, wherein the cover is secured to the compartment with multiple slide fasteners, wherein when the handhold member is pulled, at least one of the multiple slide fasteners retract around the perimeter of the cover thereby exposing the multiple safety devices.

10. The apparatus of claim 7, wherein one of the multiple safety devices is releasably attached to the compartment, and wherein the other of the multiple safety devices is removably secured to the compartment using at least one elastic strap.

11. The apparatus of claim 6, wherein one of the multiple safety devices comprises a chemical spray canister and another of the multiple safety devices comprises an audible alarm, the interconnection member being attached to the chemical spray canister and to the audible alarm, the interconnection member activating the audible alarm when the chemical spray canister is removed.

12. The apparatus of claim 11, wherein the chemical spray canister is quickly releasable from the compartment.

* * * * *